United States Patent [19]

Roehrig et al.

[11] 3,946,630

[45] Mar. 30, 1976

[54] PENDULUM SHEAR FOR CONTINUOUS CASTING INSTALLATION

[75] Inventors: Adalbert Roehrig, Wadenswil; Josef Zeller, Weesen; Adrian Stilli, Bulach, all of Switzerland

[73] Assignee: Concast AG, Zurich, Switzerland

[22] Filed: Oct. 29, 1974

[21] Appl. No.: 518,640

[30] Foreign Application Priority Data

Nov. 2, 1973 Switzerland ..... 15425/73

[52] U.S. Cl. ..... 83/311; 83/316; 83/328; 164/263

[51] Int. Cl.[2] ..... B22D 11/12

[58] Field of Search ..... 164/263; 83/311, 316, 321, 83/328

[56] References Cited

UNITED STATES PATENTS 2,261,007 10/1941 Talbot ..... 83/316 X

*Primary Examiner*—Robert D. Baldwin

*Attorney, Agent, or Firm*—Werner W. Kleeman

[57] ABSTRACT

A pendulum shear for a continuous casting installation wherein the shear is provided with a mechanical drive for a pulse-like cutting operation, a knife or cutter rigidly connected with the pendulum and movable by a driven crank towards a second knife. Further, there is provided mechanism for accelerating the pendulum out of its rest position at approximately the maximum knife opening in the direction of travel of the strand, this mechanism, prior to the cutting operation, accelerating the pendulum at its cutting region to a speed approximately corresponding to the speed of travel of the strand. The mechanism for the acceleration of the pendulum consists of a guide arranged at the stand or housing and guides the pendulum along its path between the rest position and the start of the cutting operation, and the cooperation of this guide with the pendulum moved by the crank controls such acceleration.

8 Claims, 4 Drawing Figures

PENDULUM SHEAR FOR CONTINUOUS CASTING INSTALLATION

BACKGROUND OF THE INVENTION

The present invention relates to a new and improved construction of pendulum shear for a continuous casting installation wherein the shear is provided with a mechanical drive for the pulse-like cutting operation, there is further provided a knife or cutter which is rigidly connected with the pendulum and movable by means of a driven crank towards a second cutter, and furthermore, there is provided mechanism for the acceleration of the pendulum out of its rest position at approximately the maximum opening of the knife in the direction of travel of the strand, this mechanism prior to the cutting operation accelerating the pendulum in its cutting range or region to a speed approximately corresponding to the speed of movement of the strand.

For the cutting of strands, especially billets of steel, which depart from the withdrawal device of continuous casting installations there are known to the art mechanical pendulum or flying shears. Such pendulum shears are equipped with a mechanical drive which can be connected and disconnected with the crank shaft of the pendulum for the pulse-like cutting operation. A knife or cutter rigidly connected with the pendulum is moved by the crank towards a second knife or cutter. The major portion of the displacement path of the closing movement of the knife can be used with such shears for cutting. The pendulum, upon receiving the cutting pulse or command from the strand length measuring device, is located in its rest position at the region of the dead-center with approximately maximum knife opening. A mechanism for accelerating the pendulum out of its rest position prior to the cutting operation in the direction of movement of the strand to a speed which approximately corresponds to the speed of movement of the strand, consists of a hydraulic piston-cylinder unit which is hingedly connected at the pendulum and at the stand or housing. Such hydraulic drive for the pendulum acceleration and for pendulum movement during and after the cutting operation as well as for the return of the pendulum back into the rest position, however, requires an extensive and expensive control. Additional, such controls owing to the short time cycles for such course of movement, on the one hand, and because of a certain inertia of the hydraulic system on the other hand, are only adjustable with corresponding expenditure in such a manner that during coupling the knife at the strand and during the cutting operation there do not occur any disadvantageous appreciable decelerations in the mould or accelerations of the strand movement. Particularly in the case of small billet shapes and high casting speeds decelerations or retardations can lead to overflowing of the mould and accelerations can lead to breakouts. Moreover, due to such sudden changes in speed of the strand within the mould there can occur surface defects. If for, quality-, format- or other reasons the casting speed must be changed frequently, then such shears additionally require expensive pre-programmed controls.

SUMMARY OF THE INVENTION

It is a primary object of the invention to provide a new and improved mechanical pendulum shear which with the aid of simple means allows for a precise control of the pendulum acceleration out of the rest position in the direction of movement of the strand.

A further object of the invention aims at accommodating such control also with simple means to different casting speeds.

Now in order to implement these and still further objects of the invention, which will become more readily apparent as the description proceeds, the apparatus of this development is manifested by the features that the mechanism for the acceleration of the pendulum consists of a guide arranged at the stand or housing, and which guides the pendulum along a path between the rest position and the start of the cutting operation, and the cooperation of this guide with the pendulum moved by the crank controls such acceleration.

The inventive shear is simpler and less expensive in contrast to the heretoforeknown mechanical pendulum shears. Furthermore, this shear renders possible the accommodation with the use of simple means of the movement component of the pendulum required to be parallel to the strand movement with respect to the strand speed or velocity.

Disadvantageous defects of the cutting operation, which are transmitted via the strand to the mould and cause mould overflow, strand surface defects, breakouts and the like, can be prevented with this shear. A further advantage resides in the fact that there is absent any hydraulic system with the associated controls, the maintenance and servicing of which requires qualified workers.

Depending upon the direction of rotation of the crank there is transmitted to the pendulum at the start of its movement a movement component which acts in the direction of strand travel or opposite to the direction of strand travel. The guide is thus to be arranged at the stand or housing corresponding to the direction of rotation of the crank, viewed in the direction of travel of the strand, before or after a reference guide connected with the pendulum. Advantageously, the crank possesses at the start of movement a movement component which is opposite to the direction of travel of the strand. The guide at the stand or housing, viewed in the direction of travel of the strand, is provided behind the reference guide. The curved track of the guide, with this arrangement, produces a force component which impacts at the reference guide and which imparts to the pendulum a precise acceleration. Additionally, such guide is located externally of the movement path of the reference guide during the closing and opening stroke of the cutter or knife and can be of simple construction.

The guide, for instance, can only determine the movement of the pendulum between the rest position and the start of the cutting operation, i.e. the acceleration path. In this case the strand, at the start of the cutting operation, is responsible for the further movements of the pendulum. According to a further aspect of the invention the guide can additionally guide the pendulum along its cutting path.

As a general rule in the case of billet- and bloom installations there are used tundishes with open pouring nozzles. Hence, it is impossible to avoid irregularities in the infeed of the steel. In order to maintain the bath level in the mould the withdrawal speed of the strand is regulated in accordance with the infed quantity into the mould and thus changes during normal operation within a reference speed range. If during a cut the actual strand speed is greater than the pendulum movement produced by the curved track of the guide, then the reference guide of the pendulum can leave the curved track without obstruction. In this case the strand imparts to the pendulum the required drive. On the other hand, if during a cut the actual strand speed is smaller than the speed of the pendulum movement produced by the curved path or track of the guide, then there is exerted a tension force by the guide upon the strand. In order to eliminate the disadvantageous effects of such tension force at the guide, and in order to be able to accommodate the speed of the pendulum produced by the curved track of the guide at least to the average reference strand speed, it is of advantage if, according to a further aspect of the invention, the guide during cooperation with the reference guide is rigid along the acceleration path and along the cutting path at a predetermined pressure of the reference guide upon the guide allows for a rocking action. Due to this additional mechanism the pendulum speed can be accommodated during the cutting operation to an actual casting speed which is smaller than the speed determined by the curved track of the guide. The predetermined pressure of the reference guide upon the curved track or path of the guide also assists in reducing wear of the guide.

In order to protect the cutter of knife against friction at the strand entering the shear during its opening movement and in order to eliminate a braking action brought about by the pendulum at the strand, it is possible according to a further feature of the invention to provide an additional movable guide for the pendulum at the stand or housing, which accelerates the pendulum during opening of the knife to a speed which is greater than the speed of the strand entering the shear.

The pendulum can be retracted into the rest position by springs or equivalent devices. An advantageous solution is realised if the pendulum is provided with a counterweight which ensures for the return of the pendulum into the rest position and the equilibrium in this position.

For accommodating the shear during a pour to larger fluctuations of the strand withdrawal speed, according to a further aspect of the invention, the guide can be equipped with an adjustment or positioning drive which accommodates or adjusts the position of the curved track of the guide to the momentary strand speed.

Depending upon the local position of the guide connected with the stand or housing and the reference guide mounted at the pendulum to the cutting region of the pendulum, there result different curved paths or tracks at the guide. A simple curved path which is closest to a straight line results if, according to a further feature of the invention, the pendulum is rigidly connected with the lower cutter or knife, the upper cutter or knife is attached with a crank which is offset by 180° with respect to the crank of the pendulum, and the guide and the reference guide at the pendulum are mounted at an elevational region at the stand and at the pendulum respectively, which corresponds in its position approximately to the cutting range or region.

BRIEF DESCRIPTION OF THE DRAWING

The invention will be better understood and objects other than those set forth above, will become apparent when consideration is given to the following detailed description thereof. Such description makes reference to the annexed drawing wherein.

DETAILED DESCRIPTION OF THE PREFERRED EMBODIMENTS

Figure 1:
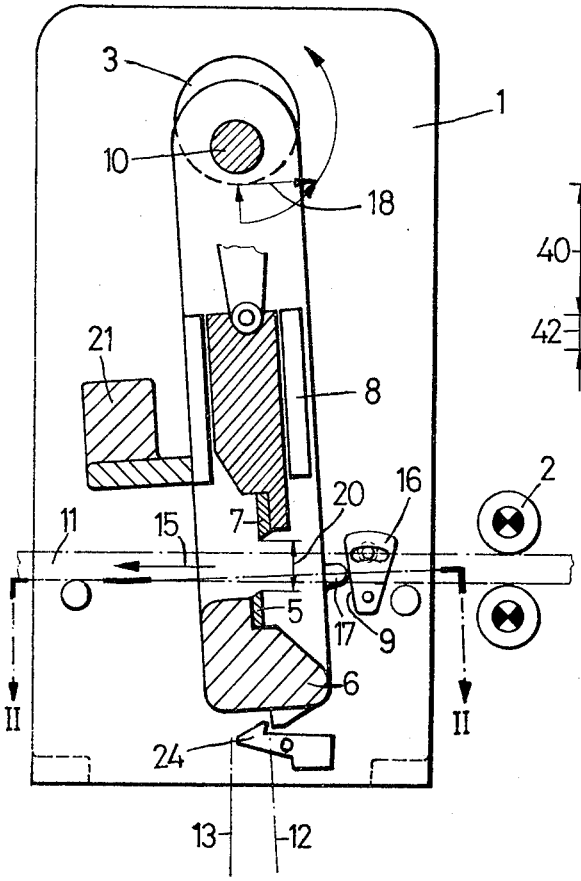
FIG. 1 is a vertical sectional view through a pendulum shear.
Figure 2:
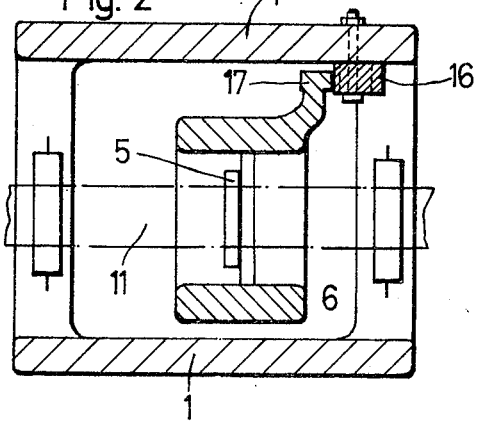
FIG. 2 is a sectional view taken substantially along the line II—II of FIG. 1.

Describing now the drawings, in FIGS. 1 and 2 there is illustrated a stationary stand or housing of a pendulum shear for a continuous casting installation. As far as the continuous casting installation itself is concerned there has only been conveniently illustrated a last pair of drive rolls 2. The drive, flywheel and coupling between the drive and a crankshaft 3 have not been illustrated for convenience and better clarity in the showing of the drawing. A lower knife or cutter 5 is rigidly connected with a pendulum 6. A crank 10 driven by the crankshaft 3 moves the lower knife 5 towards an upper knife or cutter 7. The upper knife 7 is moved along a slide guide 8 with a small stroke relative to the lower knife 5 by means of a crank, which has not been shown in FIG. 1, and which crank is offset through 180° relative to the crank 10. The broken lines represent the strand or cast product 11 which is to be cut. The pendulum has been shown in this Figure in its rest position, which in this example coincides with the lower dead-center position. The axis 12 of the pendulum 6 in the rest position, as a general rule, is displaced through an angle of 2° – 5° from the vertical axis 13. In the rest position the knife opening is largest.

A mechanism for the acceleration of the pendulum 6 out of its rest position in the direction of movement 15 of the strand 11 is provided and consists of a guide 16 arranged at the stand or housing 1 and a reference guide 17 mounted at the pendulum 6. Due to the cooperation of such guides 16 and 17, with a movement component 18 of the crank 10 which is opposite to the direction of movement 15 of the strand 11, at the start of the movement of the crank 10 there is ensured for the bearing or contact of the reference guide 17 at the curved track or path 9 of the guide 16 and there is controlled the acceleration of the pendulum. As a consequence of the movement component 18, the guide 16, viewed in the strand direction of travel 15, is arranged behind the reference guide 17. The pendulum 6 is accelerated by the guide 16 prior to the start of the cutting operation in its cutting range or region 20 to a speed which approximately corresponds to the speed of movement of the strand 11. The guide 16 of this exemplary embodiment is extended or lengthened such that the pendulum 6 during the entire cutting operation is guided and such is moved with the strand velocity with a movement component which is effective in the strand direction of travel 15. The guide 16 and the reference guide 17 mounted at the pendulum 6 are arranged at an elevational region at the stand 1 and at the pendulum 6 respectively, which in its position approximately corresponds to the cutting range or region 20. Due to the inclination of the curved track 9 there is determined the speed of movement in the strand direction of travel 15 which is transmitted to the pendulum 6. The guide 16 is therefore constructed such that the curved track 9, prior to the casting operation, is adjustable to a predetermined inclination which corresponds to the reference strand speed. A counterweight 21 ensures for the return of the pendulum 6 back into the rest position and the bearing or contact of pendulum 6 at the guide 16. This return movement also can be brought about by springs or other suitable and equivalent structure. Additionally, the pendulum 6 is held in the rest position by a pawl 24.

Figure 3:
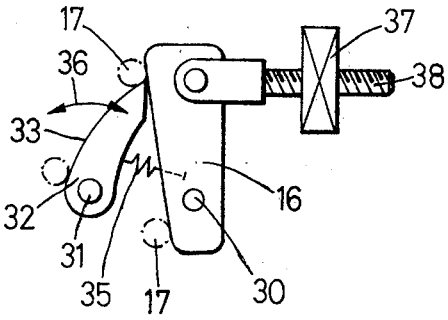
FIG. 3 is a view of another embodiment of a guide for the pendulum.

In FIG. 3 there is illustrated in detail the guide 16 for a different example. By means of a bolt 30 this guide 16 is pivotably secured to the stand or housing which has not been especially shown in this Figure. An additional guide 32 for the reference guide 17 of the pendulum 6 is likewise arranged at the stand or housing, this guide 32 being pivotable about a bolt 31 in the direction of the double-headed arrow 36. This additional guide 32 cooperates with the reference guide 17 during opening of the cutter or knife arrangement 5, 7. Due to the construction of the curved track 33 of the guide 32 the pendulum is accelerated in its cutting range 20 to a speed which is greater than the speed of the strand which enters into the shear. During the upward stroke of the pendulum 6 and by means of the reference guide 17 the guide 32 is pushed away from the guide 16. Shortly prior to the end of the upward stroke a spring 35 again draws the guide 32 against the guide 16. Instead of the pivotal movement of the guide 32 about the bolt 31 there also can be selected for instance a linear movement.

An adjustment or positioning drive 37 arranged at the stand acts upon a threaded spindle 38 which is connected with the guide 16. The adjustment or positioning drive 37 is electrically connected with the control for the strand speed. Upon change of the strand speed during casting the adjustment or positioning drive 37 changes the position or setting of the guide 16 in such a manner that the acceleration and the movement of the pendulum during the cutting operation is accommodated to the momentary strand speed. A simultaneous readjustment of the guide 32 with the guide 16 is not necessary as a general rule, because the curved track 33 can be accommodated to a speed which corresponds to the maximum possible speed of the strand format which is to be cast.

With a shear which is designed for a billet having the dimensions $130 \times 130$ mm$^2$ the cutting range or region 20, which corresponds to the sum of the knife displacement path of the lower knife 5 and the upper knife 6 respectively, amounts to for instance 150 mm and 20 mm respectively. Hence, there results a knife freedom of movement at the lower knife and at the upper knife 7 of 20 mm with respect to the strand. The dimensional relationship between the cutting region 20 and the effective cutting height with the aforementioned strand dimensions is thus, for this example, 170 : 130 or 1 : 0.76. Depending upon the necessary freedom of movement of the cutter this relationship or ratio also can be greater, for instance 1 : 0.85.

Figure 4:
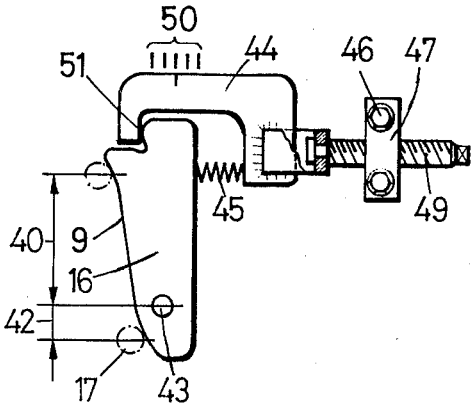
FIG. 4 is a view of a further embodiment of a guide for the pendulum.

In FIG. 4 the curved track 9 of the guide 16 is subdivided into an acceleration path 42 and a cutting path 40. The acceleration path 42 corresponds to the guide path for the reference guide 17 along the curved track 9 between the rest position and the engagement of the lower knife 5 at the strand 11 at the start of the cutting operation. The cutting path 40 corresponds to the total stroke length of the knife 5 connected with the pendulum 6 less the acceleration path 42. The guide 16 is pivotably connected via the bolt 43 with the strand or housing 1 which has not been here particularly shown. A spring 45 is clamped between the guide 16 and an adjustment or positioning mechanism 44. The adjustment or positioning mechanism 44 is connected through the agency of a threaded bracket 47 by means of screws 46 with the stand or housing 1. In the threaded bracket 47 there is rotatable a spindle 49 for, for instance, a manual crank drive. It serves to adjust or positionally set the curved track 9 for producing different movement speeds of the pendulum in accordance with a scale 50. In order that the curved track 9 is rigid along the acceleration path 42 during cooperation with the reference guide 17 the bolt 43 is placed at the height of the transition of the acceleration path 42 and the cutting path 40. A stop 51 of the adjustment mechanism 44 together with the bolt 43 prevents any tilting movement of the guide 16 during travel of the reference guide 17 along the acceleration path 42 of the curved track 9. The pendulum is thus always accelerated to the pre-adjusted reference acceleration. During further travel of the reference guide 17 along the cutting path 40 of the curved track 9 it is possible at a predetermined pressure of the reference guide 17 at the guide 16 to overcome the force of the spring 45. Consequently, the guide 16 pivots about the bolt 43. The force of the spring 45 is to be adjusted such that on the one hand there occurs a pivoting movement when the actual-strand velocity, during a cutting operation, is smaller than the speed of the pendulum produced by the curved track 9 in the strand direction of travel 15. On the other hand, the spring force must be large enough, upon completion of the cutting movement, to move the pendulum 6 without the strand with a predetermined speed without the guide 16 pivoting.

While there is shown and described present preferred embodiments of the invention, it is to be distinctly understood that the invention is not limited thereto, but may be otherwise variously embodied and practiced within the scope of the following claims. Accordingly,

What is claimed is:

1. A pendulum shear for a continuous casting installation, the shear being provided with a mechanical drive for a pulse-like cutting operation, a stand, a pendulum mounted at said stand, a first knife rigidly connected with the pendulum, a driven crank for moving the first knife towards a second knife, mechanism for the acceleration of the pendulum out of its rest position at approximately the maximum knife opening in the direction of travel of the strand, said mechanism including means for accelerating, prior to the start of the cutting operation, the pendulum in its cutting range to a predetermined speed approximately corresponding to the speed of travel of the strand, the improvement comprising said means for the acceleration of the pendulum comprising an adjustable guide arranged at the stand, said adjustable guide being structured to guide the pendulum along its path between the rest position and the start of the cutting operation, and wherein the adjustable guide is positioned to slidably cooperate with the pendulum moved by the crank to control such acceleration.

2. The pendulum shear as defined in claim 1, wherein the driven crank cooperates with said pendulum and is driven in a manner such that at the start of movement said crank possesses a movement component which is opposite to the direction of travel of the strand.

3. The pendulum shear as defined in claim 1, wherein said guide is arranged to guide the pendulum along its cutting path.

4. The pendulum shear as defined in claim 1, further including a reference guide cooperating with said guide, and means coacting with said guide such that said guide during cooperation with the reference guide is stationary along an acceleration path and along a cutting path at a predetermined pressure of the reference guide at the guide permits a rocking movement.

5. The pendulum shear as defined in claim 3, further including an additional movable guide for the pendulum provided at the stand, said movable guide having a curved track having a characteristic which accelerates the pendulum during opening of the knives to a speed which is greater than the speed of the strand entering the shear.

6. The pendulum shear as defined in claim 1, further including a counterweight provided for the pendulum which ensures for the return of the pendulum into the rest position and the coaction of the pendulum with the guide.

7. The pendulum shear as defined in claim 3, wherein the guide has a curved track and is equipped with means for adjusting the position of the curved track of the guide to the momentary strand speed.

8. The pendulum shear as defined in claim 1, wherein the pendulum is rigidly connected with the first knife defining a lower knife, the second knife defining an upper knife which is adapted to be secured to a crank which is offset by 180° with respect to the crank of the pendulum, and wherein the guide and the reference guide of the pendulum are mounted at an elevational position at the stand and at the pendulum respectively which approximately corresponds to the cutting region.

* * * * *